United States Patent [19]

Horowitz

[11] 4,062,400

[45] Dec. 13, 1977

[54] AIR HANDLING METHOD AND SYSTEM

[75] Inventor: Fred Horowitz, Teaneck, N.J.

[73] Assignee: The Port Authority of N.Y. & N.J., New York, N.Y.

[21] Appl. No.: 635,842

[22] Filed: Nov. 28, 1975

[51] Int. Cl.[2] ..... F24F 7/00

[52] U.S. Cl. ..... 165/2; 98/33 R; 165/16; 165/59

[58] Field of Search ..... 98/33 R; 62/412; 237/46; 165/59, 16, 137, 2

[56] References Cited

U.S. PATENT DOCUMENTS

| | | | |
|---|---|---|---|
| 472,163 | 4/1892 | Duffy | 237/46 X |
| 1,909,164 | 5/1933 | Bulkeley | 165/59 X |
| 1,928,331 | 9/1933 | Downs | 165/16 |
| 2,004,927 | 6/1935 | Bulkeley | 165/16 X |
| 3,669,349 | 6/1972 | Hall | 165/16 X |

FOREIGN PATENT DOCUMENTS

| | | | |
|---|---|---|---|
| 1,190,604 | 5/1970 | United Kingdom | 165/16 |

*Primary Examiner*—Martin P. Schwadron
*Assistant Examiner*—Gerald A. Michalsky
*Attorney, Agent, or Firm*—Lee C. Robinson, Jr.

[57] ABSTRACT

In an air conditioning method and system for supplying conditioned air to an enclosed space, such as a room or rooms in a building, air is withdrawn from the room at separate positions located adjacent the floor and ceiling in order to advantageously utilize the effects of a convection within the room. Depending upon the season or the demand, air withdrawn from one of these positions is discharged into the atmosphere, while air withdrawn from the other of the positions is supplied, as return air, to an air conditioning unit, at which it is heated or cooled. A predetermined amount of outside air is also supplied to the air conditioning unit with the return air and the combined air flow, after treatment in the conditioning unit, is supplied to the enclosed air space or room.

12 Claims, 3 Drawing Figures

AIR HANDLING METHOD AND SYSTEM

The present invention relates to an air conditioning method and system, and in particular to an air conditioning system which utilizes the principles of natural heat convection in order to increase the efficiency of operation of the system.

In a typical air circulating type air conditioning system used to condition air for large buildings, air from the rooms of the building is withdrawn through circulating conduits which are open to the rooms near the ceilings or in the ceiling. The air is supplied to an air conditioning unit, for cooling or heating, depending upon the demand required at the time, and is returned to the room through a second set of ducts which also may be located in the ceiling of the room.

In some systems, particularly where building codes require, outside air is continuously supplied in a predetermined quantity to the air conditioning unit so that a portion of the return air must be dumped or spilled to the atmosphere. Since all of the return air in such previously proposed systems is taken from one location in the room, usually the top of the room, the air supplied to the conditioning unit in the summertime is high temperature air, and therefore requires a greater amount of energy to be consumed by the conditioning unit in order to reduce the temperature of the air to an acceptable level. On the other hand, in the wintertime, a portion of this warm air, containing valuable and recoverable heat, is dumped to the atmosphere in order to compensate for the outside air which is supplied to the building.

It is an object of the present invention to provide an efficient air circulating air conditioning and heating system.

Another object of the present invention is to provide an efficient air conditioning system which is relatively inexpensive in construction and economical in operation.

A further object of the present invention is to provide an air conditioning system which utilizes the principles of natural convection to conserve energy during operation of the system.

The principle of natural convection of air currents is of course well known. According to that principle warm air tends to rise so that in an enclosed space such as a room the temperature of air near the ceiling is greater than the temperature of the air near the floor of the room. This principle is advantageously used in accordance with the present invention to conserve energy during both heating and cooling of an enclosed space by an air conditioning system. The present invention is particularly adapted for use in air conditioning systems where outside air is continuously supplied to the system to replenish and supplement air in the building.

The need for outside air in air conditioning systems is often regulated by local building codes which require a certain proportion of air supplied by the conditioning unit to be outside air. For example, according to the New York City building code, one third of the air supplied by air conditioning units to a building must be composed of outside air as determined by the ventilation index, with the remaining two thirds being return air.

In accordance with one embodiment of the present invention, during the cooling season when cooled or chilled air is to be supplied to the room or rooms of a building, return air for the air conditioning unit is withdrawn from the rooms near the floor so that the coolest air from the room is returned to the air conditioning unit. This return air is then chilled with the outside air supplied to the air conditioning unit and returned to the room or enclosure. At the same time, air must be removed from the room and discharged to the atmosphere in an amount substantially equal to the amount of outside air being continuously supplied to the room. This spill air is exhausted from near the top or ceiling of the room. In this manner the warmest air from the room is eliminated, while the cooler air in the room is returned to the air conditioning unit. Thus the amount of energy required to cool the air returned to the conditioning unit is reduced as compared to previously proposed systems, with a resulting reduction in energy consumption.

On the other hand, during the heating mode of operation of the system, the warm air from the ceiling area is returned to the air conditioning unit and heated there with outside air before return to the room. In this mode, the spill air is removed from the region of the room floor and dumped to the atmosphere. Thus valuable heat contained in the returned air is conserved so that less heat is required to be produced in the air conditioning unit to heat the return air and outside air to the desired level. On the other hand the cooler air in the room which will require greater heating if returned to the air conditioning unit, is removed from near the floor of the room and dumped to the atmosphere to compensate for the outside air being continuously supplied to the room.

The above, and other objects, features and advantages of this invention will be apparent in the following detailed description of an illustrative embodiment thereof, which is to be read in connection with the accompanying drawings, whrein:

Figure 1:
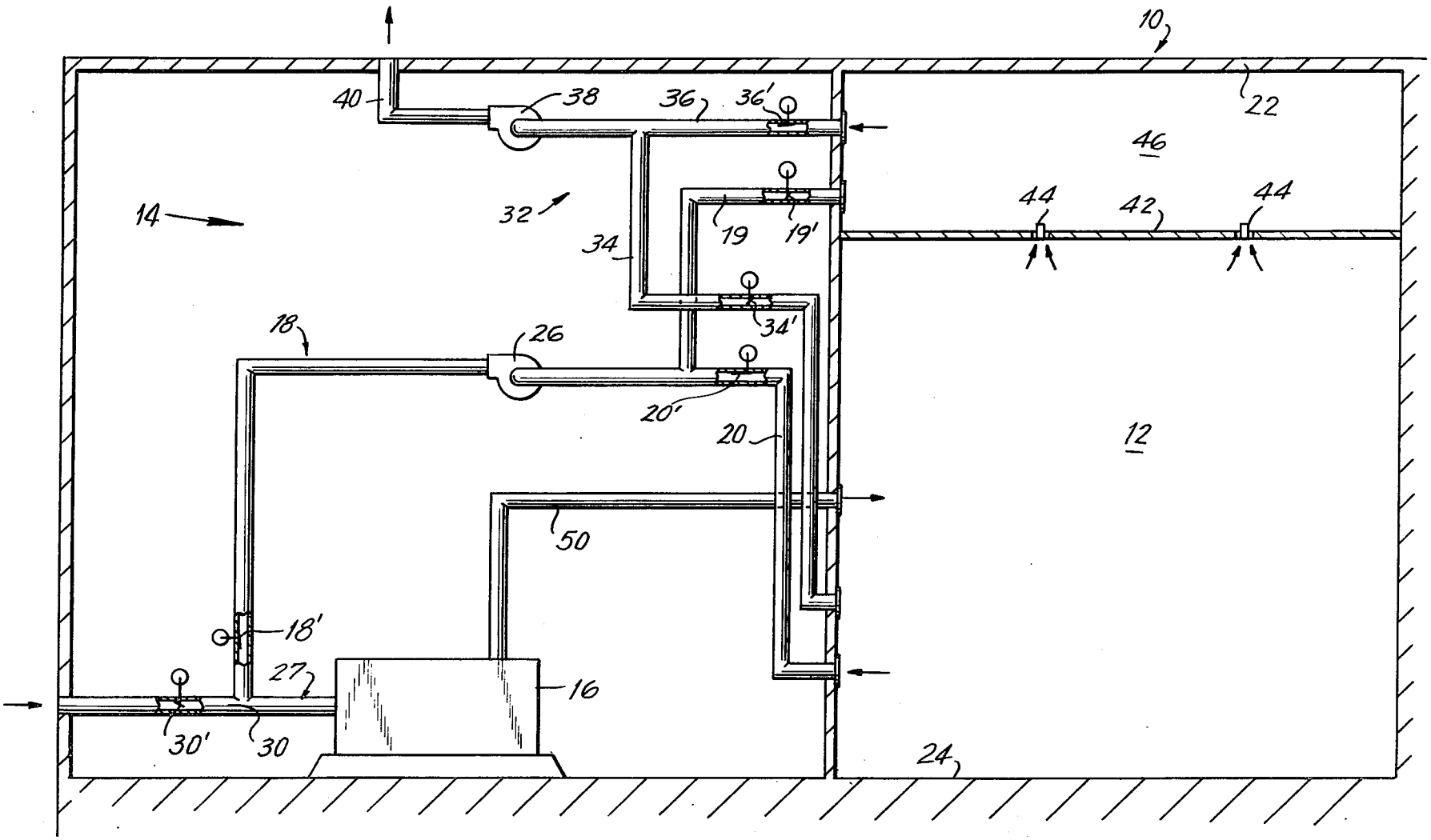
FIG. 1 is a schematic elevational view, in section, of a room and air conditioning system for use in conditioning air supplied to the room; with the conditioning system arranged for cooling air to the room.

Referring now to the drawing in detail, and initially to FIG. 1 thereof, a schematically illustrated building 10 contains an enclosed space or room 12, to which conditioned air, either heated or cooled is to be supplied. For this purpose an air conditioning system 14 is provided which includes an air handling or conditioning unit 16 that is adapted to heat and/or cool air supplied thereto. Of course it is to be understood that the air handling unit 16 can be a single conventional unit or it can be separate heating and cooling units as would be apparent to those skilled in the art. In addition, although only a single room 12 is illustrated the air conditioning system of the invention is adapted to supply conditioned air to a plurality of rooms.

Air is supplied to air handling unit 16 through a duct system 18 which includes a pair of return duct branches 19, 20, respectively connected in communication with room 12 adjacent the ceiling 22 and floor 24 of the room. Each duct branch includes a damper or valve element 19', 20' therein which is manually or automatically controlled in any convenient manner to selectively permit or prevent passage of air through its associated duct branch. Duct branches 19, 20 are in communication with a fan or blower 26 which draws air from room 12 through the opened duct branch and supplies it to air conditioning unit 16 through duct 27. The latter includes a damper 18' which also is automatically or manually operated in any convenient manner as described hereinafter.

Outside air is supplied to air conditioning unit 16 through a duct 30 which connects the exterior of the building to the unit. This duct is also provided with a damper 30' which can be selectively opened or closed and adjusted to an intermediate position to control the volume of air supplied to the air conditioning unit. As mentioned, certain building codes require a specific amount of outside air to be continuously supplied to the building. Thus, for example, the New York City building code requires that one third of all of the air supplied in an air conditioning system to the interior of a building as determined by the ventilation index be outside air. In that case, damper 30' is adjusted, as described hereinafter, to supply one third of the air which is conditioned and supplied to room 12. Thus, if unit 16 were rated as a 1,000 cubic foot per hour unit, then damper 30' would be adjusted to allow only 333 cubic feet per hour of outside air to be drawn into the unit.

An additional duct system 32 is also provided in the building for withdrawing air from the room 12. This system includes a pair of duct branches 34, 36, which respectively communicate with the room 12 adjacent the floor and ceiling of the room. Each branch has its own damper 34', 36', corresponding to the dampers previously described, and the branches communicate with a fan 38. The fan is operative to draw air through the ducts 34, 36 (depending upon which duct is opened by its associated damper) and discharge the air through the duct 40 into the atmosphere.

In the illustrative embodiment of the invention shown in FIG. 1, room 12 is provided with a false or hung ceiling 42 in which light fixtures 44 are mounted. The upper duct branches 19, 36 communicate with room 12 above false ceiling 42 so that they withdraw air from the room above the ceiling. This air enters into the chamber 46 above the ceiling 42, by convection and fan suction, preferably through vents or gratings associated with the light fixtures 44. Thus this air also serves to cool the light fixtures and withdraw heat therefrom. It is to be understood of course that the false ceiling 42 is not a necessary element in the system of the present invention, and that it can be eliminated.

In the cooling mode of operation of the air conditioning system, damper 34' in the air spill duct system 32 is closed, while damper 36' is open. At the same time damper 19' in the return air duct system 18 is closed while damper 20' is opened. Preferably all of the dampers are automatically or remotely controlled through a conventional electrical or pneumatic control system, as would be apparent to those skilled in the art. In this mode damper 30' is opened to permit a predetermined amount of air to enter into conditioning unit 16 while damper 36' is arranged to permit substantially the same volume of air to be withdrawn from adjacent the ceiling of room 12 by fan 38 and dumped to the atmosphere.

In the return air system 18, damper 20' is adjusted to allow fan 26 to supply sufficient air from the room 12 to conditioning unit 16 for satisfactory operation of the system. Thus, where one third of the necessary air is supplied from outside air, the damper 20' is arranged to allow two thirds of the necessary air to pass from the interior space 12 to the conditioning unit 16. At the conditioning unit the return air and the outside air are conditioned, i.e. cooled in the cooling mode, and discharged through a return conduit 50 to the room 12, by the fan or blower in the unit.

By this arrangement is is seen that in the cooling mode of operation the warmest air from room 12 is dumped to the atmosphere as waste air while the coolest air from the room is returned to the conditioning unit for cooling. As a result, less cooling of the return air is required in the conditioning unit 16 than would be needed with conventional air conditioning systems wherein the return air is drawn from the top of the room.

Figure 2:
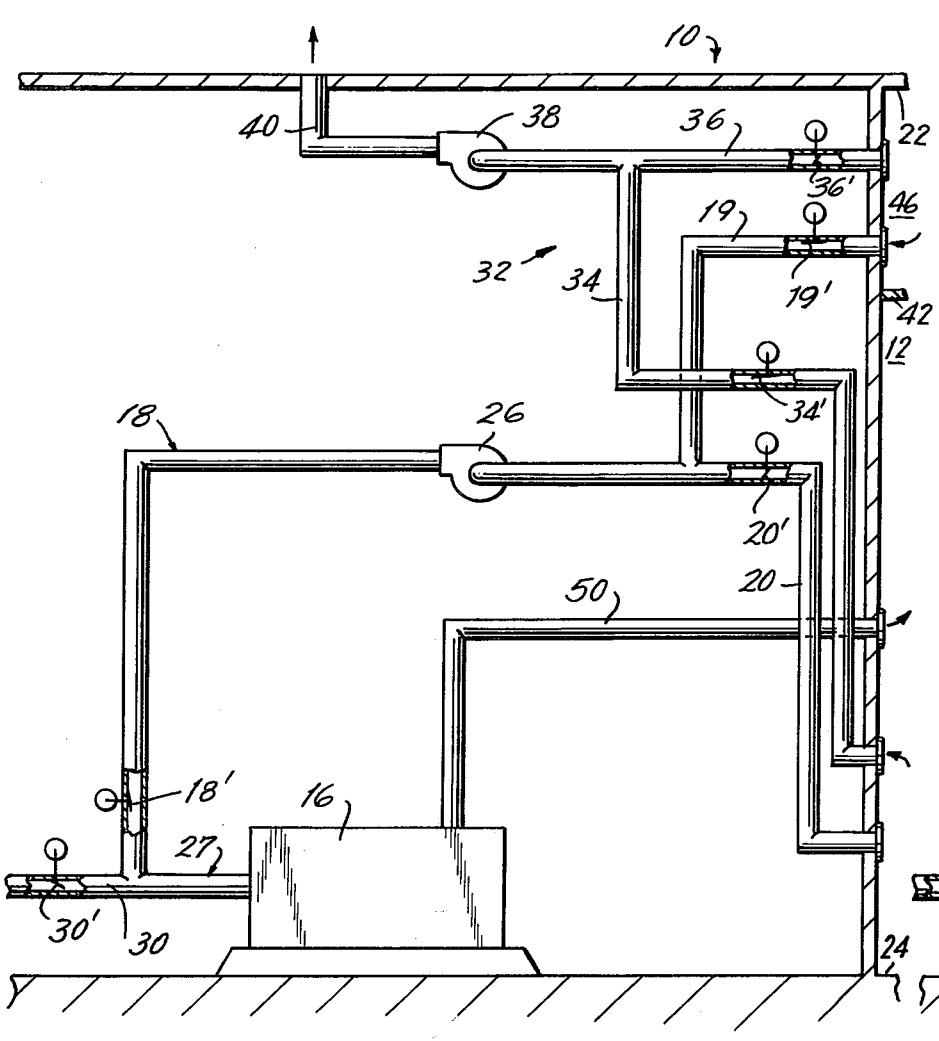
FIG. 2 is a partial elevational view, similar to FIG. 1, showing the air conditioning system arranged for supplying heated air to the room.

In the heating mode of operation of the system, as illustrated in FIG. 2, damper 36' is closed and damper 19' is opened so that warm air from above hung ceiling 42 is supplied by fan 26 to conditioning unit 16 which, in this mode, heats the return and outside air. At the same time damper 34' is opened and damper 20' is closed so that the relatively cooler air from adjacent the floor of room 12 is spilled to the atmosphere through fan 38. In this mode of operation the warmest air from the room is returned to the conditioning unit 16 so that less heat is required to be produced by the conditioning unit in order to supply the needed heated air to the room. At the same time the cooler air in the room (which otherwise would have to be heated in conditioning unit 16) is dumped to the atmosphere.

In both embodiments of the invention it is seen that the conditioned air is supplied to the room through the conduit 50 at a relatively high position in the room above the floor or from the hung ceiling down. By supplying air to the room in this location, improved air mixing in the air conditioned space will be achieved so that the temperature below the hung ceiling and in the occupyable space of the room will be more uniform, and the space above the hung ceiling will be stagnant, allowing highest air temperature there.

Figure 3:
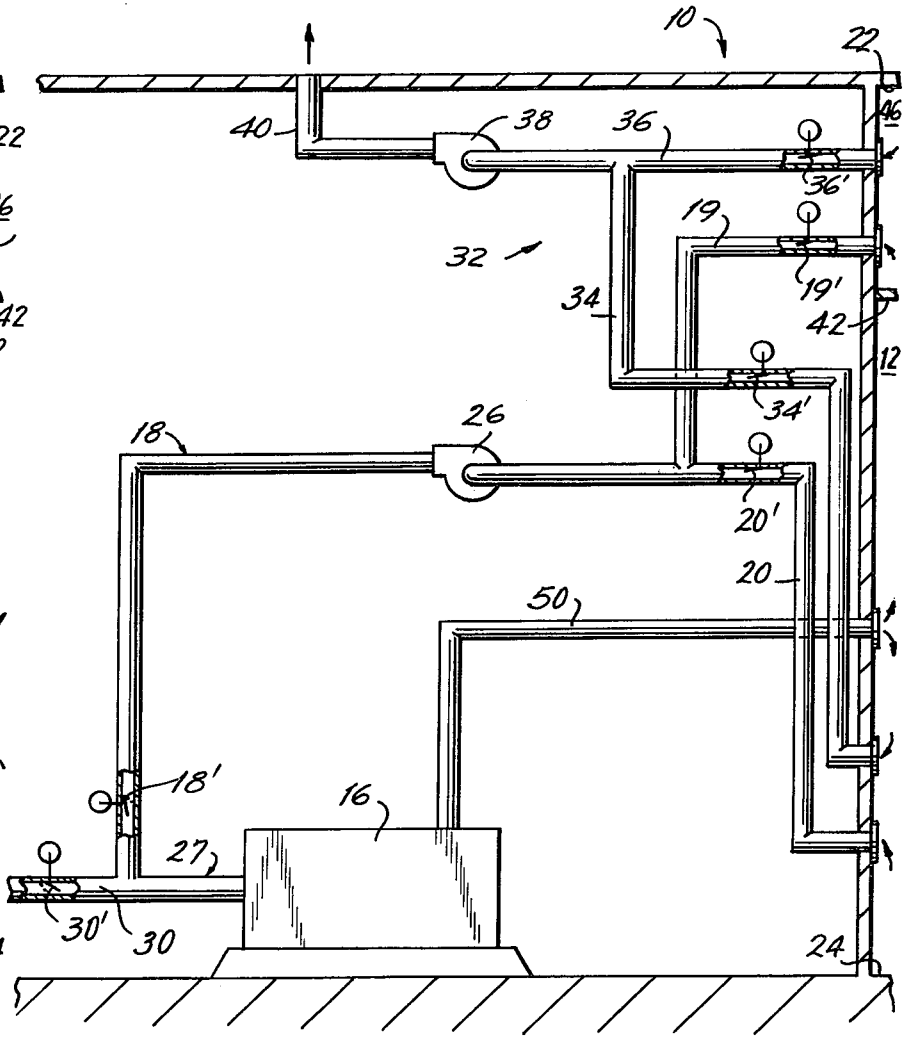
FIG. 3 is a partial sectional view, similar to FIG. 1, showing the arrangement for the system when outside air can be used to cool the room.

Preferably exhaust fan 38 is of a multi-speed or variable pitch blade design so that the exhaust capacity of the fan can be adjusted. This is of importance when the outside air temperature is such that more than the minimum required amount of outside air can be supplied to the interior of the building for the purpose of cooling. That is, it may happen during certain periods of the year that the outside air temperature may be sufficiently cool to allow it to be used to cool the interior of the building, thereby reducing the amount of energy required for cooling. In this situation, a greater amount of air is drawn into the building and likewise a greater amount of air must be expelled from the building by fan 38. In such an arrangement the controls for the dampers 30' and 18' are modulated in response to thermostatic controls in the room in order to maintain the desired room temperature. The other dampers 19', 20', 34' and 36', are held fully open so that air is withdrawn from the room at all of the ducts 19, 20, 34 and 36 (see FIG. 3).

In this mode, exhaust fan 38 is controlled (for example by a pressure sensor within the room) to adjust the blade pitch, or fan speed, depending upon the type of fan utilized, so that the amount of air withdrawn from room 12 is substantially equal to the amount of outside air introduced to the room through the damper 30'. Thus, in addition to increasing the efficiency of the air conditioning system the duct arrangement according to the present invention increases the flexibility of the system to allow outside air itself to be used to cool the building.

Of course it will be understood that although the illustrative embodiment of the invention has been described herein with reference to a single room in a building, this system is adaptable to buildings having a large number of rooms, with the duct work being modified accordingly so that the air flow continues in the manner described for the simplified version of the duct work illustrated in the drawings.

Although an illustrative embodiment of the present invention has been described herein with reference to the accompanying drawings, it is to be understood that the invention is not limited to that precise embodiment thereof, but that various changes and modifications can be effected therein without departing from the scope or spirit of this invention.

What is claimed is:

1. An air conditioning method for supplying conditioned air to an enclosed space which comprises, the steps of, withdrawing air from said enclosed space at separate positions located adjacent the top and bottom of the enclosed space, discharging the air withdrawn from one of said positions into the atmosphere; supplying the air from the other of said positions as return air to a conditioning unit, simultaneously supplying a predetermined amount of outside air to the conditioning unit with said return air, conditioning the return air and outside air at the conditioning unit, and supplying the conditioned air to said enclosed space; said conditioning step comprising the step of heating the return air and outside air, and said step of withdrawing air from the enclosed space comprising the steps of withdrawing the return air from said position adjacent the top of the enclosed space and withdrawing the air to be discharged to the atmosphere from adjacent the bottom of the enclosed space.

2. An air conditioning method for supplying conditioned air to an enclosed space which comprises, the steps of, withdrawing air from said enclosed space at separate positions located adjacent the top and bottom of the enclosed space, discharging the air withdrawn from one of said positions into the atmosphere, supplying the air from the other of said positions as return air to a conditioning unit, simultaneously supplying a predetermined amount of outside air to the conditioning unit with said return air, conditioning the return air and outside air at the conditioning unit, and supplying the conditioned air to said enclosed space, said conditioning step comprising the step of cooling the return air and outside air, and said step of withdrawing air from the enclosed space comprising the steps of withdrawing the return air from said position adjacent the bottom of the enclosed space and withdrawing the air to be discharged to the atmosphere from adjacent the top of the enclosed space.

3. An air conditioning method for supplying heated air to at least one room in a building which method comprises the steps of withdrawing air from adjacent the floor of the room and discharging the air to the atmosphere, withdrawing air from adjacent the ceiling of the room and supplying it, as return air, to an air heating unit; simultaneously supplying a predetermined amount of outside air to the heating unit with said return air, heating the combined return air and outside air at the heating unit, and supplying the heated air to said room.

4. An air conditioning method for supplying cooled air to at least one room in a building, which method comprises the steps of withdrawing air from adjacent the ceiling of the room and discharging the air to the atmosphere, withdrawing air from adjacent the floor of the room and supplying it, as return air, to an air cooling unit; simultaneously supplying a predetermined amount of outside air to the cooling unit with said return air, cooling the combined return air and outside air at the cooling unit, and supplying the cooled air to said room.

5. An air conditioning method for selectively heating and cooling an enclosed air space such as at least one room in a building, said method comprising the steps of withdrawing air from said room at two positions respectively located adjacent the floor and ceiling of the room while supplying a predetermined amount of outside air to a conditioning unit;

selectively heating said room by discharging the air withdrawn from adjacent the floor of the room to the atmosphere, supplying the air withdrawn from adjacent the ceiling of the room to the conditioning unit with said outside air, heating the air at the conditioning unit and supplying the heated air to said room; and selectively cooling said room by discharging the air withdrawn from adjacent the ceiling of the room to the atmosphere, supplying the air withdrawn from adjacent the floor of the room to the conditioning unit with said outside air, cooling the air at the conditioning unit and supplying the cooled air to said room.

6. The method as defined in claim 5 including the step of controlling the discharge of air from said room so that the volume of discharged air approximately equals the volume of outside air supplied to the conditioning unit.

7. An air conditioning system for conditioning air in an enclosed space which comprises, means for conditioning air and supplying it to said enclosed space; means for withdrawing air from said enclosed space at separate positions located adjacent the top and bottom of the enclosed space and discharging air withdrawn from one of said positions into the atmosphere while supplying the air from the other of said positions as return air to said conditioning means, and means for supplying a predetermined amount of outside air to the conditioning unit with said return air, whereby the outside air and return air are conditioned by said conditioning means and supplied to said room; said conditioning means comprising means for heating said return air and said outside air and said withdrawing means comprising means for withdrawing air from adjacent the bottom of said enclosed space and discharging it to the atmosphere and means for withdrawing air from adjacent the top of said enclosed space and supplying it to said heating means.

8. An air conditioning system for conditioning air in an enclosed space which comprises, means for conditioning air and supplying it to said enclosed space, means for withdrawing air from said enclosed space at separate positions located adjacent the top and bottom of the enclosed space and discharging air withdrawn from one of said positions into the atmosphere while supplying the air from the other of said positions as return air to said conditioning means, and means for supplying a predetermined amount of outside air to the conditioning unit with said return air, whereby the outside air and returned air are conditioned by said conditioning means and supplied to said room, said conditioning means comprising means for cooling said return air and said outside air and said withdrawing means comprising means for withdrawing air from adjacent the top of said enclosed space and discharging it to the atmosphere and means for withdrawing air from adjacent the bottom of said enclosed space and supplying it to said cooling means.

9. An air conditioning system for supplying conditioned air to at least one room in a building comprising, means for conditioning air and supplying it to said at least one room, first air conduit means for selectively withdrawing air from positions adjacent the ceiling and bottom of said room and supplying the withdrawn air to said conditioning unit as return air, second conduit means for selectively withdrawing air from positions adjacent the ceiling and bottom of said room and discharging the withdrawn air to the atmosphere; and means for supplying a predetermined amount of outside air to said conditioning unit, whereby said return air and outside air are conditioned by said conditioning means and supplied to said room while some of the air in the room is discharged to the atmosphere.

10. The air conditioning system as defined in claim 9 wherein said conditioning means comprises air heating means, said first conduit means withdraws warm air from adjacent the ceiling of said room and supplies the warm air to said conditioning means and said second conduit means withdraws cool air from adjacent the bottom of the room and discharges it to the atmosphere whereby the required heat output of said heating means, for heating return air, is reduced.

11. The air conditioning system as defined in claim 10 wherein said conditioning means includes means for selectively cooling return air and outside air supplied thereto and, in the cooling mode, said first conduit means is operated to withdraw cool air from adjacent the bottom of said room and supply it to said conditioning means for cooling while said second conduit means is operated to withdraw warmer air from adjacent the top of the room and discharge it to the atmosphere whereby the required cooling output of said conditioning means, for cooling return air, is reduced.

12. The air conditioning system as defined in claim 9 wherein said conditioning means comprises air cooling means, said first conduit means withdraws cool air from adjacent the bottom of said room and supplies the cool air to said conditioning means and said second conduit means withdraws warmer air from adjacent the top of the room and discharges it to the atmosphere whereby the required cooling output of said conditioning means, for cooling return air, is reduced.

* * * * *